United States Patent [19]

Protzeller

[11] 3,946,263

[45] Mar. 23, 1976

[54] ENCAPSULATED LAMP ASSEMBLY

[76] Inventor: Harry W. Protzeller, 3328 Sandra Drive, Shreveport, La. 71109

[22] Filed: Dec. 23, 1974

[21] Appl. No.: 536,958

[52] U.S. Cl. ..... 313/312; 313/317; 313/318; 339/147 C

[51] Int. Cl.[2] ..... H01J 5/02; H01J 19/54

[58] Field of Search ..... 313/111, 112, 113, 318, 313/312, 317; 339/147 C

[56] References Cited

UNITED STATES PATENTS

| | | | |
|---|---|---|---|
| 2,424,990 | 8/1947 | Krim | 313/312 X |
| 2,813,922 | 11/1957 | Arnold | 313/318 X |
| 3,218,500 | 11/1965 | Wright et al. | 313/111 X |
| 3,322,992 | 5/1967 | Parker et al. | 313/111 |
| 3,541,381 | 11/1970 | Matsuya | 313/318 |
| 3,706,902 | 12/1972 | Cookson | 313/318 |

*Primary Examiner*—Saxfield Chatmon, Jr.
*Attorney, Agent, or Firm*—John M. Harrison

[57] ABSTRACT

An encapsulated lamp assembly for use under submerged conditions and in environments where the lamp may be subjected to extreme temperature variations and corrosive conditions, which includes a bulb and base unit with single or multiple filaments and leads cooperating with the filament busses. The leads are typically soldered to the busses, and the entire unit is sprayed, brushed or dipped in a silicone composition to provide a thin film of protective silicone material on the outside and on the junction between the leads and the busses. A rubber boot is positioned on the leads to insure a thick coating on the lead-bus junctions, and the lamp assembly can be fitted to any conventional bracket mechanism.

7 Claims, 8 Drawing Figures

ENCAPSULATED LAMP ASSEMBLY

Cross References to Related Applications

Encapsulated lamps and lamp systems in the prior art have taken the form of baseless bulbs carrying an internal filament and encapsulated in a block of a thermosetting resin material, as described in U.S. Pat. No. 3,322,992 to E. M. Parker, et al, issued May 30, 1967. The lamp described and claimed in this patent is designed to operate in a variety of environments and is not subject to attack by corrosive or otherwise harmful liquids and gases.

Another encapsulated lamp is described and claimed in U.S. Pat. No. 3,218,500 to Peter Wright, et al, patented Nov. 16, 1965. This patent discloses an electric lamp having a transparent or translucent polystyrene, acrylic, polyethylene, or similar compound covering over the bulb.

BACKGROUND OF THE INVENTION

1. Field of the Invention

This invention relates to a new and improved lamp for use under submerged conditions and under circumstances where the bulb base and leads are exposed to water and other environments which are detrimental to conventional lamps. More particularly, the invention relates to a new and improved lamp assembly, including a bulb and base, which is coated with a silicone composition to make the entire assembly waterproof. The assembly may then be inserted in any one of several conventional brackets and mounted as desired. In one embodiment of the invention, the bulb, base assembly and leads are coated with a thin film of silicone material, which film provides a protective coating over the bulb and lead connections to minimize the effect of thermal and impact shock as well as corrosion resistance when the light is dropped on a hard surface or immersed in water, or otherwise exposed to corrosive environments. The film forms a sealed coating which prevents moisture from entering the lamp assembly, including the bulb and base units.

2. Description of the Prior Art

Heretofore, various attempts have been made to provide a lamp assembly having a protective coating to protect the assembly against the effects of water and other harsh environments which tend to corrode the assembly, and also against thermal and impact shock which causes the bulb to break. Such lamp assemblies have a wide variety of uses, such as illumination of instruments in airplanes, boats and the like, and use in all vehicles, including automobiles, tractor trailers, trucks, boat trailers, automobile trailers and similar vehicles, as back up lights, tail lights, clearance and side marker lights. One factor which frequently causes difficulty in the use of miniature lamp assemblies is the high operating temperature of the lamps due to the small radiation surfaces of the bulbs used. Accordingly, when such lamps are used in vehicle trailers and particularly, boat trailers which must frequently be submerged to load and unload boats, the thermal shock caused by the hot lamp touching the cool water frequently results in breakage of the bulb. Another problem inherent in the use of both large and small lamps is breakage when the lamp is dropped on a hard surface such as concrete. Yet another problem frequently realized as a result of exposure of the lamp assembly to harsh environments such as salt water and areas of high humidity, is the problem of corrosion at the point where the leads join the lamp busses or filament bases. This problem is frequently intensified by moisture seeping into the lamp base area from the annulus between the connector wire and its insulating jacket as a result of breaks in the insulation between the lamp base and the electrical source. Accordingly, when bulbs are changed in the lamp and bracket assembly, corrosion frequently prevents good electrical contact between the base or busses of the lamp and the leads, thereby frequently inhibiting proper operation of the lamp.

Yet another problem inherent in conventional lamps is the tendency for corrosion to occur at the point where the filament busses touch the wire leads in the metal mounting bracket itself.

Accordingly, an object of this invention is to provide an improved lamp which is resistant to thermal and impact shock, which is corrosion resistant, and which is adapted to fit into conventional mounting brackets.

Another object of this invention is to provide a new and improved lamp which is coated with a silicone composition to impart corrosion, impact shock, and thermal shock resistance to the lamp assembly, and to prevent moisture from entering any part of the lamp assembly.

A still further object of the invention is to provide a miniature lamp assembly which is coated with a thin layer of silicone composition to prevent the bulb from breaking when the assembly is exposed to rapidly changing temperatures, corrosive environmental conditions and dropped on hard surfaces.

Yet another object of the invention is to provide a new and improved base and bulb light assembly to which base leads are soldered or otherwise appropriately connected, and an appropriate silicone composition coating is applied to the bulb base and leads to provide a sealed unit and impart corrosion resistance, thermal shock resistance, and impact shock resistance to the assembly.

Another object of the invention is to provide a method of encapsulating small lamps and bulbs and the lead connections thereto in a sealed unit with a silicone composition to provide thermal and impact shock resistance and corrosion resistance to the lamps and bulbs, which sealed unit is capable of being removably inserted into a conventional mounting bracket.

A still further object of the invention is to provide a new and improved lamp assembly and procedure for coating the assembly with a silicone composition by use of a rubber boot designed to fit on the leads and accumulate the silicone composition in the appropriate position over the lead connections in order to insure adequate coating of the connections and to provide a suitable means for holding the lamp assembly in place inside a conventional bracket without the necessity of springs or other means for achieving good contact between the vehicle lead wires and the lamp assembly.

Yet another object of the invention is to provide as improved sealed encapsulated lamp which is not subject to corrosion from moisture seeping into the lamp base from breaks in the lead wire insulation and which removably fits inside substantially any conventional holding bracket.

SUMMARY OF THE INVENTION

These and other objects of the invention are provided in a new and improved lamp which includes the following:

1. A base adapted with busses or electrical lead fittings;

2. A bulb in cooperation with the base, the interior of which bulb contains one or more filaments mounted in a filament base, which filaments are in electrical cooperation with the busses;

3. Leads attached to the busses by solder or other appropriate means;

4. A rubber boot fitted over the leads and designed to cover the lead connections with the busses and help hold the lamp in a conventional mounting bracket; and 5. A silicone composition coating over the entire base, bulb, leads and boot component parts to provide shock resistance, impact resistance and corrosion resistance to the lamp, and to prevent moisture from entering any part of the lamp.

BRIEF DESCRIPTION OF THE DRAWINGS

The invention will be better understood in view of the following description presented with reference to the accompanying drawings.

DESCRIPTION OF THE PREFERRED EMBODIMENTS

Figure 1:
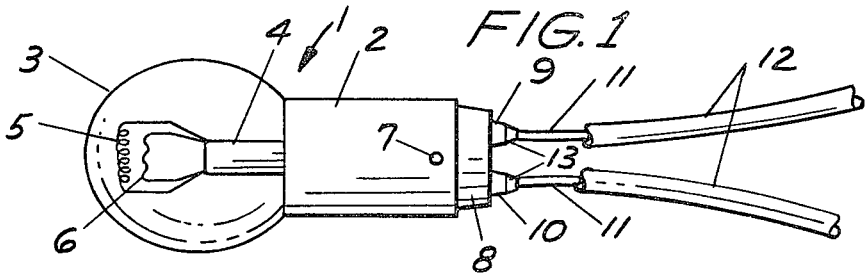
FIG. 1 of the drawing is a top elevation of the lamp of this invention illustrating the leads, lead connections, base and bulb.

Referring now to FIG. 1 of the drawing, the lamp of this invention, generally illustrated by reference numeral 1, is shown, with base 2, bulb 3, and filament base 4, carrying filaments 5 and 6. Base projection 7 serves to help mount the lamp in a light receptacle, or bracket, and base insulator 8 serves to carry filament busses or connectors 9 and 10, to which leads 11 are affixed by means of solder 13. Leads 11 carry insulation 12, and are ultimately in electrical cooperation through the vehicle wiring system with an energy source. Leads 11 may be fitted in cooperation with busses 9 by crimped connectors or other suitable means known to those skilled in the art.

Figure 2:
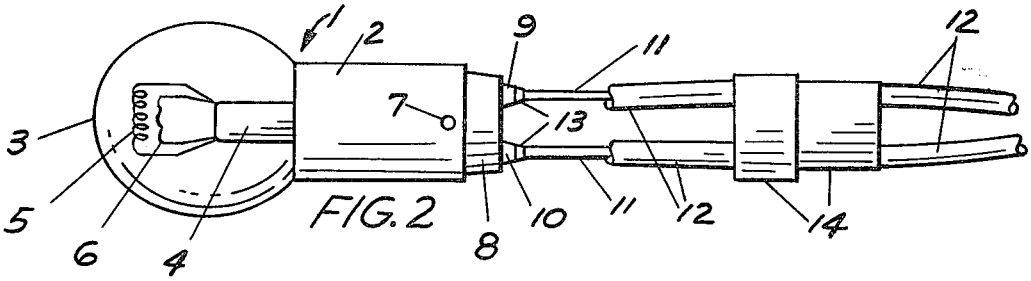
FIG. 2 is a top elevation of the lamp illustrated in FIG. 1, further illustrating a boot which is designed to cover the leads after the silicone composition coating is in place.

Referring now to FIG. 2 of the drawing, boot 14 is illustrated with leads 11 and insulation 12 positioned in the interior thereof. Boot 14 is designed to slide laterally on insulation 12, and is initially positioned below the point of juncture between leads 11 and busses 9 and 10.

Figure 3:
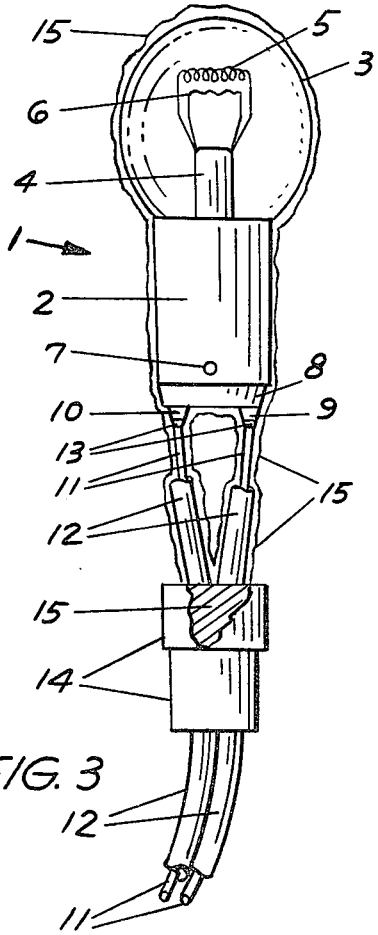
FIG. 3 is a top elevation of the lamp illustrated in FIGS. 1 and 2, more particularly disclosing the silicone coating covering the bulb base, leads, busses and lead insulation of the lamp.

FIG. 3 illustrates lamp 1 in vertical position after being dipped in silicone composition 15, with boot 14 in place as shown in FIG. 2, and a layer of silicone composition 15 covering base 2, bulb 3, base insulator 8, busses 9 and 10, solder 13, leads 11 and the interior of boot 14.

Figure 4:
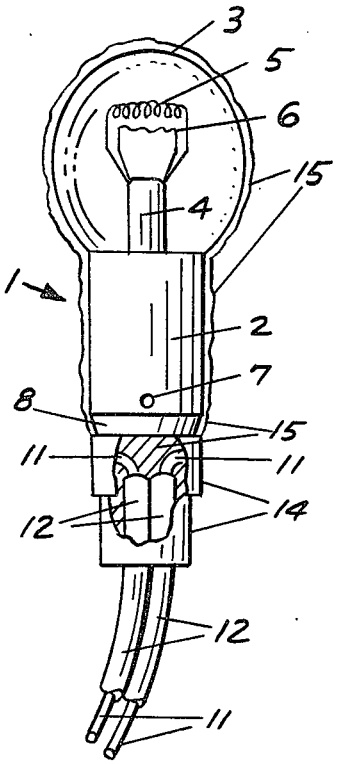
FIG. 4 is a top elevation of the lamp illustrated in FIGS. 1–3 showing the boot in position, and more particularly illustrating the positioning of the silicone coating within the boot and on the component parts of the lamp.

Referring now to FIG. 4 of the drawing, when boot 14 fills with accumulated silicone composition 15, the boot is pushed upward on insulation 12 against base insulator 8 to provide a thick capsule of silicone composition in the interior of boot 15 which tightly seals leads 11, insulation 12, busses 9 and 10 and solder 13. This capsule serves to insure that a corrosive atmosphere or submersion in a corrosive liquid, such as water, will not enter any part of the lamp and result in harmful damage to the leads 11, busses 9 and 10 or solder 13, joining leads 11 and busses 9 and 10.

Figure 5:
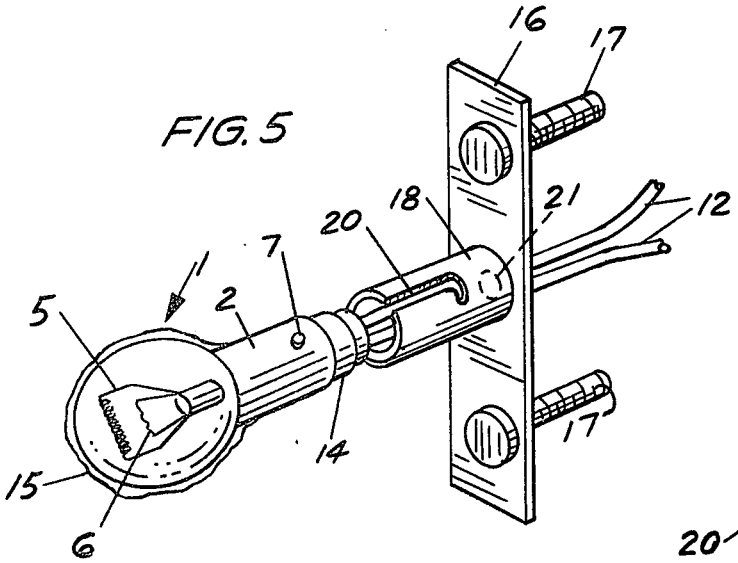
FIG. 5 is a perspective view of the lamp illustrated in FIGS. 1–4 in position ready to be mounted in a conventional bracket.
Figure 6:
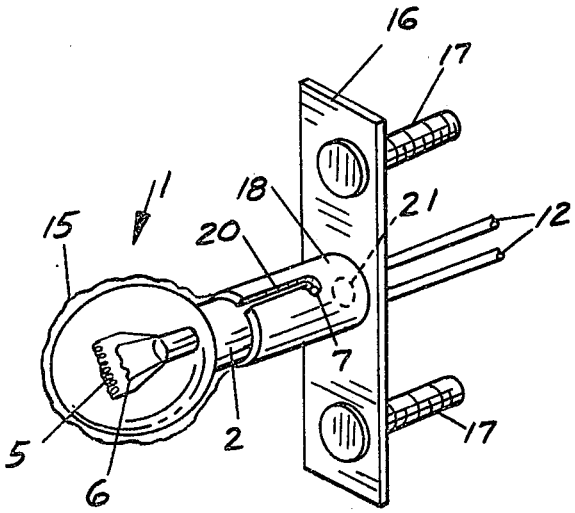
FIG. 6 is a perspective view of the lamp illustrated in FIGS. 1–5 mounted in a bracket.

After lamp 1 is encapsulated to form a sealed unit, it can be inserted into lamp receptacle 18 of bracket 16, as illustrated in FIGS. 5 and 6 of the drawing. Base projections 7 on base 2 of lamp 1 are adapted to register with top and bottom lamp receptacle slots 19 and 20 to hold base 2 in tight contact with lamp receptacle 18. Bracket 16 can then be conventionally mounted on a vehicle by means of bolts 17.

Figure 7:
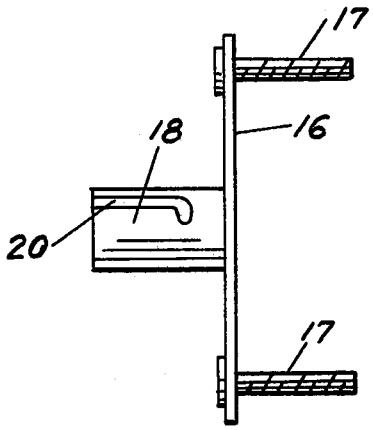
FIG. 7 is a left side elevation of the conventional mounting bracket illustrated in FIGS. 5 and 6.
Figure 8:
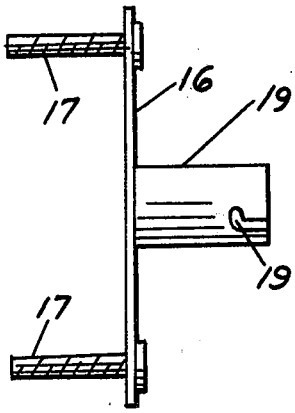
FIG. 8 is a right side elevation of the conventional mounting bracket illustrated in FIGS. 5–7.

Referring now to FIGS. 7 and 8 of the drawing, and as described generally above, top lamp receptacle slot 19, illustrated in FIG. 8 and bottom lamp receptacle slot 20, shown in FIG. 7, are adapted to receive base projections 7 and hold base 2 inside lamp receptacle 18. Referring again to FIGS. 5 and 6, leads 11, covered by insulation 12, are projected through an opening 21 at the base of lamp receptacle 18. Boot 14 is then compressed as base projections 7 are aligned with and traverse top and bottom lamp receptacle slots 19 and 20, respectively, and are finally locked in place as shown in FIG. 6. Leads 11 are then connected to the vehicle wiring in any conventional manner known to those skilled in the art and the bulb-bracket connection is waterproof, corrosion proof and impact proof.

In practice, a preferred method of coating the lamp of this invention consists of initially joining leads 11 to busses 9 and 10 by means of solder 13, or other suitable techniques. Insulation 12, covering leads 11, is first stripped from the leads in order to be sure that a good solder joint is achieved between the leads and the busses. The next step consists of de-greasing the entire lamp, solder, and leads with a suitable cleaner such as naphtha, or other solvent. After drying thoroughly, the lamp is dipped into a silicone composition thinned with xylene, xylol, methylethyl ketone, naphtha or trichlorethylene, and the unit is positioned with the bulb in an upward position in order to allow the silicone composition to flow. The excess of the composition is allowed to accumulate in a boot 14, as illustrated in FIG. 3 of the drawing. After boot 14 fills with silicone composition, the boot is pushed upwardly against base insulator 8 as illustrated in FIG. 4 of the drawing, and the entire lamp is allowed to dry. Alternatively, the lamp may be coated with the silicone composition by spraying or brushing the composition on the lamp.

The coating of a lamp by the technique of this invention results in a silicone composition thickness of about three to about 6 mils on the bulb and base portions of the lamp. Within the interior of the boot, the composition is as thick as the interior diameter of the boot, and covers the leads, busses and joint with a homogeneous, thick coating. Accordingly, the bulb assembly may be very efficiently used on substantially any light or lamp which may be subjected to a corrosive environment such as salt encrusted streets and roads, areas of high humidity, and conditions of water immersion. The thick coating made possible by use of the boot not only insures that no water or other corrosive fluid can attack the lead-busses junction, but it also prevents seeping of moisture or other fluids into the lead-bus connections from the annulus formed between the lead wires and insulating jackets in the event of a break in the insulation.

Although the silicone composition of this invention may be used in the form supplied commercially, such as the formulations disclosed in Dow Coming U.S. Pat. Nos. 3,077,465 and 3,035,016, it is preferred to dilute the composition with a suitable diluent such as xylene, xylol, methylethyl ketone, naphtha or trichlorethylene, to a desired viscosity. For example, it has been found that about three parts silicone composition to about one part diluent, and more preferably, about 2½ parts silicone composition to about one part diluent produces a composition having a sufficient viscosity to provide a coating of preferred thickness of about 3 to about 6 mils on the lamp bulb and base. Coatings of varying thickness can, therefore, be produced by varying the viscosity of the silicone coating composition.

It is significant that production of a lamp according to this invention provides an assembly which can either be inserted into a socket or bracket of conventional design as illustrated and described above, or in the absence of such a bracket, is compatible with substantially any other mechanical means for maintaining a desired positioning of the lamp. Accordingly, the lamp of this invention can be inserted into a conventional bracket such as that illustrated in the drawing without the need for conventional electrical contacts and means for maintaining bulb position and biasing the bulb in the mounting socket.

Having described my invention with the particularity noted above, what is claimed is:

1. An encapsulated lamp for insertion in mounting brackets of vehicles comprising:

a. a base;

b. a bulb carried by said base and fitted with at least one filament;

c. at least one bus mounted on said base and in electrical cooperation with said at least one filament;

d. electrical leads fitted to said at least one bus;

e. a boot having a first portion in cooperation with said leads and having a second larger portion fitted over said at least one bus and the portion of said leads fitted to said at least one bus;

f. a silicone composition coating over said at least one bus, said bulb, and said base, and a core of silicone composition inside said boot.

2. The encapsulated lamp of claim 1 further comprising at least one base projection on said base for removable attachment of said base to a lamp receptacle.

3. The encapsulated lamp of claim 1 wherein said coating is from about 3 to about 6 mils thick on said base and said bulb.

4. The encapsulated lamp of claim 1 wherein said electrical leads are soldered to said at least one bus.

5. The encapsulated lamp of claim 1 wherein:

(a) said coating is from about three to about six mils thick on said base and said bulb; and (b) said electrical leads are soldered to said at least one bus.

6. The encapsulated lamp of claim 1 wherein said coating is about three mils thick.

7. The encapsulated lamp of claim 1 wherein:

a. said coating is about three mils thick; and b. said electrical leads are soldered to said at least one bus.

* * * * *